US008900010B2

(12) United States Patent
Aoki et al.

(10) Patent No.: US 8,900,010 B2
(45) Date of Patent: Dec. 2, 2014

(54) CONNECTION STRUCTURE OF CRIMPING TERMINAL TO ELECTRICAL WIRE

(75) Inventors: Hiroshi Aoki, Toyoda (JP); Naoki Kobayashi, Toyota (JP)

(73) Assignee: Yazaki Corporation, Tokyo (JP)

( * ) Notice: Subject to any disclaimer, the term of this patent is extended or adjusted under 35 U.S.C. 154(b) by 187 days.

(21) Appl. No.: 13/583,052

(22) PCT Filed: Mar. 23, 2011

(86) PCT No.: PCT/JP2011/056973

§ 371 (c)(1),
(2), (4) Date: Sep. 6, 2012

(87) PCT Pub. No.: WO2011/118626

PCT Pub. Date: Sep. 29, 2011

(65) Prior Publication Data

US 2012/0329317 A1 Dec. 27, 2012

(30) Foreign Application Priority Data

Mar. 23, 2010 (JP) ..... 2010-066853

(51) Int. Cl.

| | |
|---|---|
| ***H01R 13/40*** | (2006.01) |
| ***H01R 4/18*** | (2006.01) |
| *H01R 4/20* | (2006.01) |
| *H01R 13/52* | (2006.01) |

(52) U.S. Cl.

CPC *H01R 4/185* (2013.01); *H01R 4/20* (2013.01); *H01R 13/52* (2013.01)

USPC ..... 439/587

(58) Field of Classification Search

CPC ..... H01R 13/5208; H01R 13/5205; H01R 13/5221; H01R 13/5219; H01R 13/521

USPC ..... 439/587, 585, 519

See application file for complete search history.

(56) References Cited

U.S. PATENT DOCUMENTS

| | | | | |
|---|---|---|---|---|
| 2,729,695 | A * | 1/1956 | Pierce | 174/84 C |
| 3,670,293 | A * | 6/1972 | Garver | 439/585 |

(Continued)

FOREIGN PATENT DOCUMENTS

| | | | |
|---|---|---|---|
| CN | 1574488 | A | 2/2005 |
| JP | 11054182 | A | 2/1999 |

(Continued)

OTHER PUBLICATIONS

Office Action dated Sep. 25, 2013 issued by the Korean Intellectual Property Office in corresponding Korean Patent Application No. 10-2012-7023072.

(Continued)

*Primary Examiner* — Amy Cohen Johnson
*Assistant Examiner* — Vladimir Imas
(74) *Attorney, Agent, or Firm* — Sughrue Mion, PLLC

(57) ABSTRACT

An upper side of the distal end of an electric wire is covered with cover members made of water-absorbing resin layers in which impermeable layers are formed on the inner surface sides abutting on a conductor before crimping previously so as to include at least a portion having the possibility of exposing the conductor of the electric wire to the outside when a conductor crimping part and a sheath crimping part of a crimping terminal are respectively crimped to the conductor and the portion having an insulating sheath of the distal end of the electric wire, and conductor crimping pieces and sheath crimping pieces are crimped onto the cover members and thereby, the cover members are held by the conductor crimping pieces and the sheath crimping pieces with an exposed portion of the conductor covered.

3 Claims, 3 Drawing Sheets

(56) References Cited

U.S. PATENT DOCUMENTS

| | | | | |
|---|---|---|---|---|
| 3,699,504 | A * | 10/1972 | Huber | 439/585 |
| 3,955,044 | A * | 5/1976 | Hoffman et al. | 174/84 C |
| 5,519,170 | A * | 5/1996 | Nabeshima | 174/74 R |
| 5,603,637 | A * | 2/1997 | Matsuoka et al. | 439/587 |
| 5,611,706 | A * | 3/1997 | Makita et al. | 439/275 |
| 5,749,756 | A * | 5/1998 | Vockroth et al. | 439/879 |
| 6,334,798 | B1 * | 1/2002 | Ushijima et al. | 439/879 |
| 6,384,335 | B1 * | 5/2002 | Saito et al. | 174/74 R |
| 6,808,417 | B2 * | 10/2004 | Yoshida | 439/585 |
| 6,951,483 | B2 * | 10/2005 | Kameyama | 439/595 |
| 6,953,365 | B2 * | 10/2005 | Tabata et al. | 439/587 |
| 7,048,551 | B2 * | 5/2006 | Takayama | 439/67 |
| 7,115,004 | B2 * | 10/2006 | Takayama | 439/852 |
| 7,207,850 | B2 * | 4/2007 | Takayama | 439/852 |
| 7,494,388 | B2 * | 2/2009 | Kakuta | 439/879 |
| 7,632,144 | B2 * | 12/2009 | Sakaguchi et al. | 439/585 |
| 7,686,647 | B1 * | 3/2010 | Hong | 439/595 |
| 7,883,365 | B2 * | 2/2011 | Saitou | 439/587 |
| 7,909,647 | B2 * | 3/2011 | Kawaguchi et al. | 439/585 |
| 8,011,954 | B2 * | 9/2011 | Nagafuchi | 439/585 |
| 8,177,591 | B2 * | 5/2012 | Okamura et al. | 439/877 |
| 8,414,329 | B2 * | 4/2013 | Morikawa | 439/585 |
| 8,607,449 | B2 * | 12/2013 | Kitagawa et al. | 29/863 |
| 2002/0027013 | A1 * | 3/2002 | Kondo | 174/110 R |
| 2002/0171207 | A1 * | 11/2002 | Torii et al. | 277/607 |
| 2005/0003709 | A1 | 1/2005 | Nagamine et al. | |
| 2012/0329318 | A1 * | 12/2012 | Aoki et al. | 439/521 |
| 2013/0045644 | A1 * | 2/2013 | Aoki et al. | 439/878 |

FOREIGN PATENT DOCUMENTS

| | | | |
|---|---|---|---|
| JP | 2001313113 | A | 11/2001 |
| JP | 2006-286385 | A | 10/2006 |
| JP | 2007012329 | A | 1/2007 |

OTHER PUBLICATIONS

Office Action dated Jan. 31, 2014 issued by the Japanese Patent Office in counterpart Japanese Patent Application No. 2010-066853.

Written Opinion dated May 24, 2011 issued in International Application No. PCT/JP2011/056973 (PCT/ISA/237).

International Search Report dated May 24, 2011 issued in International Application No. PCT/JP2011/056973 (PCT/ISA/210).

Office Action dated Jun. 18, 2014 issued by the State Intellectual Property Office of the People's Republic of China in counterpart Chinese Patent Application No. 201180015567.0.

Communication dated Mar. 27, 2014 from the Korean Intellectual Property Office in a counterpart Korean application No. 10-2012-7023072.

* cited by examiner

CONNECTION STRUCTURE OF CRIMPING TERMINAL TO ELECTRICAL WIRE

TECHNICAL FIELD

The present invention relates to a connection structure of a crimping terminal to an electric wire.

BACKGROUND ART

FIG. 5 shows a connection structure between a terminal and an electric wire described in Patent Reference 1.

This terminal 110 has an electrical connection part 111 connected to a battery etc. in the front, and also has an electric wire connection part 112 connected to the distal end of an electric wire W by ultrasonic welding in the back of the electrical connection part 111. The electric wire connection part 112 includes a conductor connection part 114 positioned in the front side, and a sheath fixing part 115 positioned in the back side of the conductor connection part 114, and the conductor connection part 114 is formed in a U-shaped cross section by having a base plate part 121, and a pair of side wall parts 122, 122 upwardly erected from both lateral edges of the base plate part 121. The distal end of the electric wire W is electrically and mechanically connected to the terminal 110 by placing a conductor Wa exposed by removing an insulating sheath Wb on the base plate part 121 of the conductor connection part 114 and holding the portion covered with the insulating sheath Wb in the sheath fixing part 115 and welding the conductor Wa to the base plate part 121 of the conductor connection part 114 in that state.

PRIOR ART REFERENCE

Patent Reference

Patent Reference 1: JP-A-2007-12329

DISCLOSURE OF THE INVENTION

Problems that the Invention is to Solve

Incidentally, in the conventional connection structure between the terminal and the electric wire described above, the conductor Wa of the distal end of the electric wire W connected to the terminal 110 remains exposed to the outside, so that when water adheres to the conductor Wa, the conductor Wa is susceptible to corrosion, with the result that there was fear of damaging electrical connection reliability.

The invention has been implemented in view of the circumstances described above, and an object of the invention is to provide a connection structure of a crimping terminal to an electric wire constructed so that even when water adheres to an electric wire connection part, the water is prevented from entering a conductor of the electric wire to prevent a problem of corrosion of the conductor of the electric wire and fear of damaging electrical connection reliability can be solved.

Means for Solving the Problems

In order to achieve the object described above, a connection structure of a crimping terminal to an electric wire according to the invention is characterized by the following (1) to (3).

(1) A connection structure of a crimping terminal to an electric wire, the crimping terminal comprising an electrical connection part for making connection to the other terminal in a front thereof, and an electric wire connection part crimped and connected to a distal end of an electric wire in a back of the electrical connection part, the electric wire connection part including a conductor crimping part positioned in a front side thereof and a sheath crimping part positioned in a back side of the conductor crimping part; wherein the conductor crimping part is formed in substantially a U shape in cross-section view and having a base plate part and a pair of conductor crimping pieces which upwardly extends from both lateral edges of the base plate part and are crimped so as to obtain a state in which a conductor is brought into close contact with an upper surface of the base plate part by inwardly bending the conductor crimping pieces so as to wrap the conductor exposed by removing a portion of a sheath of the distal end of the electric wire to be connected; the sheath crimping part is formed in substantially a U shape in cross-section view and having a base plate part and a pair of sheath crimping pieces which upwardly extends from both lateral edges of the base plate part and are crimped so as to obtain a state in which a portion of a sheath is brought into close contact with an upper surface of the base plate part by inwardly bending the sheath crimping pieces so as to wrap the portion of the sheath of the distal end of the electric wire to be connected; the base plate part of the conductor crimping part and the base plate part of the sheath crimping part are formed as a common base plate part; and an upper side of the distal end of the electric wire is covered with a cover member made of a water-absorbing resin before crimping previously so as to include at least a portion having the possibility of exposing the conductor of the electric wire to the outside when the conductor crimping part and the sheath crimping part are respectively crimped to the conductor and the portion of the sheath of the distal end of the electric wire, and the conductor crimping pieces and the sheath crimping pieces are crimped onto the cover member and thereby the cover member is held by the conductor crimping pieces and the sheath crimping pieces with an exposed portion of the conductor covered.

(2) In the connection structure of the crimping terminal to the electric wire with the configuration of the above (1), the conductor exposed between the conductor crimping part and the sheath crimping part is covered with a first cover member as the cover member and a front end of the first cover member is extended to a position in which the conductor crimping pieces of the conductor crimping part are crimped and also a back end of the first cover member is extended to a position in which the sheath crimping pieces of the sheath crimping part are crimped and on the other hand, a top surface of the conductor of the electric wire is covered with a second cover member as the cover member.

(3) In the connection structure of the crimping terminal to the electric wire with the configuration of the above (1) or (2), the cover member is made by forming an impermeable layer on a side abutting on the electric wire.

According to the connection structure of the crimping terminal to the electric wire with the configuration of the above (1), the conductor crimping pieces of the conductor crimping part and the sheath crimping pieces of the sheath crimping part of the crimping terminal are respectively crimped to the conductor exposed by removing the sheath of the distal end of the electric wire and the portion having the sheath after the distal end of the electric wire is covered with the cover member made of the water-absorbing resin, so that all the exposed portion of the conductor is covered with the cover member and even if water adheres to the electric wire connection part, the water-absorbing resin constructing the cover member can actively absorb the water. Therefore, corrosion of the conductor due to adhesion of the water can be prevented and reliability of connection between the crimping terminal and the electric wire can be maintained over a long period of time.

According to the connection structure of the crimping terminal to the electric wire with the configuration of the above (2), the cover member is formed as two components of the first cover member and the second cover member and thereby, the exposed portion of the conductor can be covered in the minimum range after the conductor crimping part or the sheath crimping part is crimped. Therefore, in the portion necessary to maximize the area of contact between the terminal and the conductor of the electric wire, like the conductor crimping part, high electrical connection performance can be maintained by minimizing the cover member which becomes the obstacle.

According to the connection structure of the crimping terminal to the electric wire with the configuration of the above (3), an inner surface of the cover member is provided with the impermeable layer, so that water can surely be inhibited from entering the conductor present in the inside of the cover member.

Advantage of the Invention

According to the invention, even when water adheres to the part of connection between the terminal and the electric wire, the water can be prevented from entering the conductor of the electric wire to prevent a problem of corrosion of the conductor of the electric wire, with the result that fear of damaging electrical connection reliability can be solved.

The invention has been described above briefly. Further, the details of the invention will become more apparent by reading through a mode for carrying out the invention described below with reference to the accompanying drawings.

MODE FOR CARRYING OUT THE INVENTION

An embodiment of the invention will hereinafter be described with reference to the drawings.

In addition, in the invention, the side connected to the other terminal etc. in a crimping terminal is set at the front, and the side connected to an electric wire in the crimping terminal is set at the back.

Figure 1A:
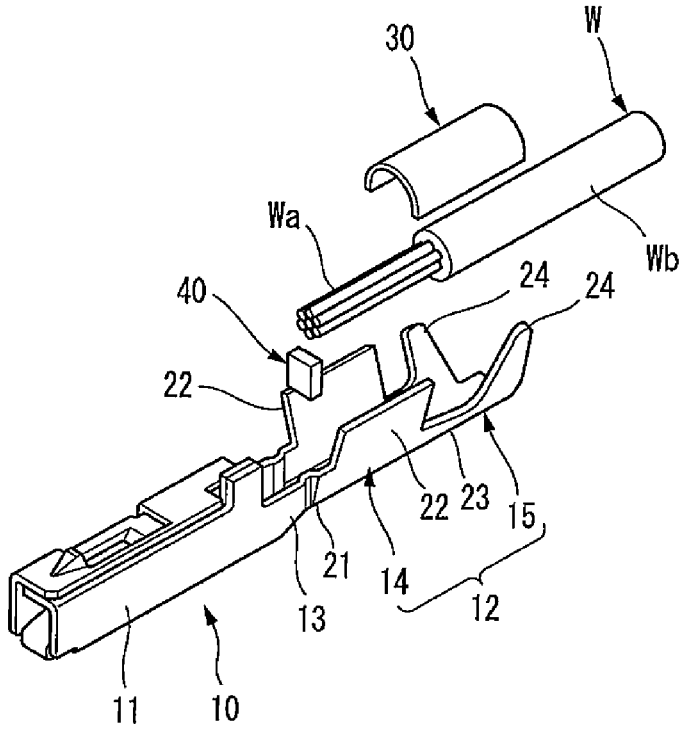
FIGS. 1(*a*) and 1(*b*) are explanatory diagrams of an embodiment of the invention, and FIG. 1(*a*) is an exploded perspective view of a connection structure of a crimping terminal to an electric wire, and FIG. 1(*b*) is a partially enlarged sectional view of cover members used therein.
Figure 1B:
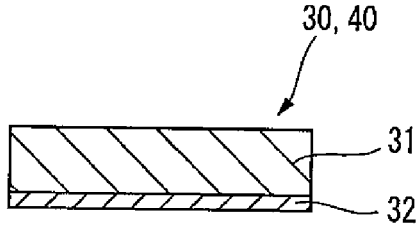
Figure 2:
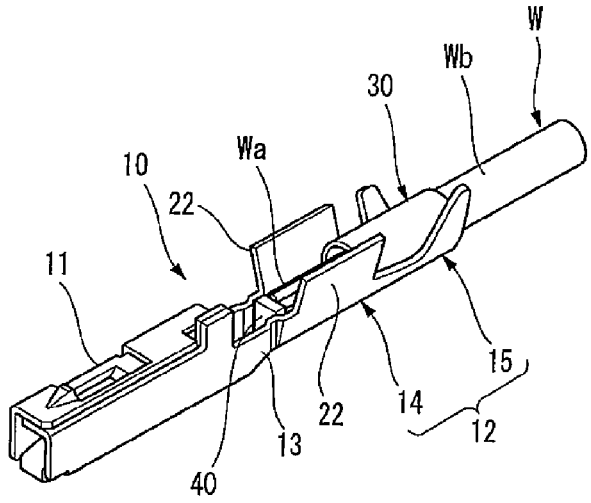
FIG. 2 is a perspective view showing a state in which the cover members and the distal end of the electric wire are set in an electric wire connection part of the crimping terminal before crimping.
Figure 3:
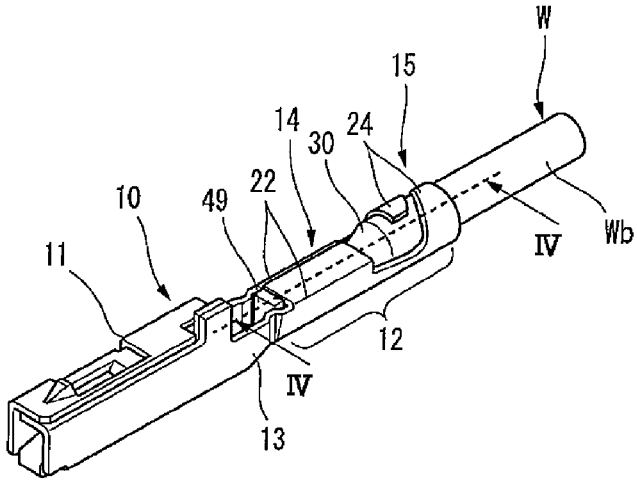
FIG. 3 is a perspective view showing the connection structure of the embodiment, and is a perspective view showing a state in which the connection structure of the crimping terminal to the electric wire is completed by crimping conductor crimping pieces of a conductor crimping part and sheath crimping pieces of a sheath crimping part of the crimping terminal after the distal end of the electric wire is set as shown in FIG. 2.
Figure 4:
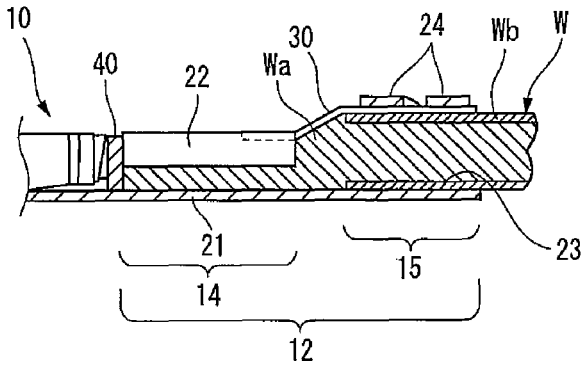
FIG. 4 is a sectional view taken on arrow IV-IV of FIG. 3.
Figure 5:
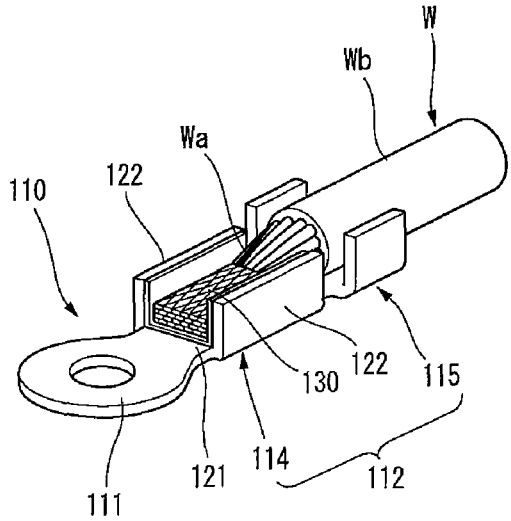
FIG. 5 is a perspective view showing one example of a conventional connection structure between a terminal and an electric wire.

FIG. 1(*a*) is an exploded perspective view of a connection structure of a crimping terminal to an electric wire of the embodiment according to the invention, and FIG. 1(*b*) is a partially enlarged sectional view of cover members used therein, and FIG. 2 is a perspective view showing a state in which the cover members and the distal end of the electric wire are set in an electric wire connection part of the crimping terminal before crimping in order to implement the same connection structure, and FIG. 3 is a perspective view showing a state in which the connection structure is completed by crimping conductor crimping pieces of a conductor crimping part and sheath crimping pieces of a sheath crimping part of the crimping terminal after the distal end of the electric wire is set as shown in FIG. 2, and FIG. 4 is a sectional view taken on arrow IV-IV of FIG. 3.

The connection structure of the crimping terminal to the electric wire of the invention is characterized in that a conductor portion of the electric wire is covered with a cover member when the crimping terminal is crimped to the electric wire.

As shown in FIG. 1(*a*), this crimping terminal 10 is a female terminal, and has a box-shaped electrical connection part 11, with a built-in spring piece, for making connection to the other terminal etc. (not shown) in the front, and has an electric wire connection part 12 crimped and connected to the distal end of an electric wire W through a joining part 13 in the back of the electrical connection part 11.

The electric wire connection part 12 includes a conductor crimping part 14 positioned in the front side, and a sheath crimping part 15 positioned in the back side of the conductor crimping part 14. The conductor crimping part 14 of the front side is formed in substantially a U shape in cross-section view by a base plate part 21 and a pair of conductor crimping pieces 22 upwardly extending from both lateral edges of the base plate part 21, and the conductor crimping pieces 22 are crimped so as to obtain a state in which a conductor Wa is brought into close contact with an upper surface of the base plate part 21 by inwardly bending the conductor crimping pieces 22 so as to wrap the conductor Wa exposed by removing an insulating sheath (hereinafter also called a sheath simply) Wb of the distal end of the electric wire W to be connected. Also, the sheath crimping part 15 of the back side is formed in substantially a U shape in cross-section view by a base plate part 23 and a pair of sheath crimping pieces 24 upwardly extending from both lateral edges of the base plate part 23, and the sheath crimping pieces 24 are crimped so as to obtain a state in which the portion covered with the insulating sheath Wb of the distal end of the electric wire W is brought into close contact with an upper surface of the base plate part 23 by inwardly bending the sheath crimping pieces 24 so as to wrap the portion having the insulating sheath Wb of the distal end of the electric wire W to be connected. In the embodiment, the base plate part 21 of the conductor crimping part 14 and the base plate part 23 of the sheath crimping part 15 are continuously formed as a common base plate part.

Cover members 30, 40 are constructed of water-absorbing resins. As the water-absorbing resin, a macromolecular water-absorbing polymer etc. are given. As shown in FIG. 1(*b*), in the cover members 30, 40, impermeable layers 32 are formed on the sides (that is, the inner surface sides of the cover members 30, 40) abutting on the electric wire W in water-absorbing resin layers 31.

As the cover members 30, 40, commercially available members can be used and, for example, Aqua Pearl (a trade name, manufactured by San-Dia Polymers, Ltd.) etc. are given.

In the case of obtaining the connection structure of the embodiment, the upper side of the distal end of the electric wire W is covered with the cover members 30, 40 made of the water-absorbing resin layers 31 with the impermeable layers 32 formed on the inner surface sides before crimping previously so as to include at least the portion having the possibility of exposing the conductor Wa of the electric wire W to the outside when the conductor crimping part 14 and the sheath crimping part 15 of the crimping terminal 10 are respectively crimped to the conductor Wa and the portion having the insulating sheath Wb of the distal end of the electric wire W as shown in FIGS. 1 and 2. In that case, the conductor Wa exposed between the conductor crimping part 14 and the sheath crimping part 15 is covered with the first cover member 30 with a semicylinder shape, and the front end of the first cover member 30 is extended to a position in which the conductor crimping pieces 22 of the conductor crimping part 14 are crimped and also, the back end of the first cover member 30 is extended to a position in which the sheath crimping pieces 24 of the sheath crimping part 15 are crimped. Also, a top surface of the conductor Wa of the electric wire W is covered with the second cover member 40.

Next, as shown in FIG. 3, by crimping the conductor crimping pieces 22 and the sheath crimping pieces 24 with the cover members 30, 40 arranged, the cover members 30, 40 are held by the conductor crimping pieces 22 and the sheath crimping pieces 24 with the exposed portion of the conductor Wa covered. Consequently, the connection structure of the crimping terminal 10 to the electric wire W is completed.

According to the connection structure configured thus, as shown in FIG. 4, the conductor crimping pieces 22 of the conductor crimping part 14 and the sheath crimping pieces 24 of the sheath crimping part 15 of the crimping terminal 10 are respectively crimped to the conductor Wa exposed by removing the sheath Wb of the distal end of the electric wire W and the portion having the sheath Wb after the distal end of the electric wire W is covered with the cover members 30, 40 made of the water-absorbing resins, so that all the exposed portion of the conductor Wa is covered with the cover members 30, 40 and even if water adheres to the electric wire connection part 12 and enters the inside, the water-absorbing resin layers 31 constructing the cover members 30, 40 can actively absorb the water. Moreover, since the inner surfaces of the cover members 30, 40 are provided with the impermeable layers 32, the water can surely be inhibited from entering the conductor Wa present in the insides of the cover members 30, 40. Therefore, corrosion of the conductor Wa due to adhesion of the water can be prevented and reliability of connection between the crimping terminal 10 and the electric wire W can be maintained over a long period of time.

Also, according to the connection structure of the embodiment, the cover member is formed as two components of the first cover member 30 and the second cover member 40 and thereby, the exposed portion of the conductor Wa can be covered in the minimum range after the conductor crimping part 14 or the sheath crimping part 15 is crimped. Therefore, in the portion necessary to maximize the area of contact between the crimping terminal 10 and the conductor Wa of the electric wire W, like the conductor crimping part 14, high electrical connection performance can be maintained by minimizing the cover member which becomes the obstacle.

In addition, the invention is not limited to the embodiment described above, and modifications, improvements, etc. can be made properly. Moreover, as long as the invention can be achieved, the number of components, materials, shapes, dimensions, arrangement places, etc. of each component in the embodiment described above are arbitrary and are not limited.

For example, it can be devised so as not to decrease the area of contact between the conductor Wa and the conductor crimping pieces 22 of the conductor crimping part 14 while integrally forming the first cover member 30 and the second cover member 40.

Also, it can be constructed so that only the first cover member 30 is used and the second cover member 40 with which the top surface of the conductor Wa is covered is omitted and the omitted portion is covered with a waterproof resin etc.

The invention has been described in detail with reference to the specific embodiment, but it is apparent to those skilled in the art that various changes or modifications can be made without departing from the spirit and scope of the invention. The present application is based on Japanese patent application (patent application No. 2010-066853) filed on Mar. 23, 2010, and the contents of the patent application are hereby incorporated by reference.

DESCRIPTION OF REFERENCE NUMERALS AND SIGNS

W ELECTRIC WIRE
Wa CONDUCTOR
Wb INSULATING SHEATH
10 CRIMPING TERMINAL
11 ELECTRICAL CONNECTION PART
12 ELECTRIC WIRE CONNECTION PART
14 CONDUCTOR CRIMPING PART
15 SHEATH CRIMPING PART
21 BASE PLATE PART
22 CONDUCTOR CRIMPING PIECE
23 BASE PLATE PART
24 SHEATH CRIMPING PIECE
30 FIRST COVER MEMBER
31 WATER-ABSORBING RESIN LAYER
32 IMPERMEABLE LAYER
40 SECOND COVER MEMBER

The invention claimed is:

1. A connection structure of a crimping terminal to an electric wire, the crimping terminal comprising:

an electrical connection part for making connection to the other terminal in a front thereof; and an electric wire connection part crimped and connected to a distal end of an electric wire in a back of the electrical connection part, the electric wire connection part including a conductor crimping part positioned in a front side thereof and a sheath crimping part positioned in a back side of the conductor crimping part;

wherein the conductor crimping part is formed in substantially a U shape in cross-section view and having a base plate part and a pair of conductor crimping pieces which upwardly extends from both lateral edges of the base plate part and are crimped so as to obtain a state in which a conductor is brought into close contact with an upper surface of the base plate part by inwardly bending the conductor crimping pieces so as to wrap the conductor exposed by removing a portion of a sheath of the distal end of the electric wire to be connected;

the sheath crimping part is formed in substantially a U shape in cross-section view and having a base plate part and a pair of sheath crimping pieces which upwardly extends from both lateral edges of the base plate part and are crimped so as to obtain a state in which a portion of a sheath is brought into close contact with an upper surface of the base plate part by inwardly bending the sheath crimping pieces so as to wrap the portion of the sheath of the distal end of the electric wire to be connected;

the base plate part of the conductor crimping part and the base plate part of the sheath crimping part are formed as a common base plate part; and an upper side of the distal end of the electric wire is covered with a cover member, made of a water-absorbing resin before crimping previously so as to include at least a portion having the possibility of exposing the conductor of the electric wire to the outside when the conductor crimping part and the sheath crimping part are respectively crimped to the conductor and the portion of the sheath of the distal end of the electric wire, and the conductor crimping pieces and the sheath crimping pieces are crimped onto the cover member and thereby the cover member is held by the conductor crimping pieces and the sheath crimping pieces with an exposed portion of the conductor covered.

2. The connection structure of the crimping terminal to the electric wire according to claim 1, wherein the conductor exposed between the conductor crimping part and the sheath crimping part is covered with a first cover member as the cover member and a front end of the first cover member is extended to a position in which the conductor crimping pieces of the conductor crimping part are crimped and also a back end of the first cover member is extended to a position in which the sheath crimping pieces of the sheath crimping part are crimped and on the other hand, a top surface of the conductor of the electric wire is covered with a second cover member as the cover member.

3. The connection structure of the crimping terminal to the electric wire according to claim 1, wherein the cover member is made by forming an impermeable layer on a side abutting on the electric wire.

* * * * *